United States Patent [19]

Kitamura

[11] 4,040,863

[45] Aug. 9, 1977

[54] METHOD OF TREATING SURFACE OF COPPER AND ITS ALLOYS

[75] Inventor: Koji Kitamura, Fuji, Japan

[73] Assignee: Tokai Denka Kogyo Kabushiki Kaisha, Tokyo, Japan

[21] Appl. No.: 735,442

[22] Filed: Oct. 26, 1976

[30] Foreign Application Priority Data

Jan. 14, 1976 Japan ..... 51-2737

[51] Int. Cl.[2] ..... B08B 3/08

[52] U.S. Cl. ..... 134/3; 134/41; 156/666; 423/272

[58] Field of Search ..... 134/3, 41; 252/100, 252/101, 104, 87, 79.4, 79.2; 423/272, 273; 156/18

[56] References Cited

U.S. PATENT DOCUMENTS

| | | | |
|---|---|---|---|
| 3,293,093 | 12/1966 | Jones et al. | 252/79.4 X |
| 3,483,050 | 12/1969 | Banush | 252/79.2 X |
| 3,556,883 | 1/1971 | Naito et al. | 252/79.4 X |
| 3,597,290 | 8/1971 | Naito et al. | 252/79.4 X |
| 3,635,836 | 1/1972 | Mullen | 252/79.4 X |
| 3,649,194 | 3/1972 | Glanville | 134/3 |
| 3,864,271 | 2/1975 | Stalter | 252/100 X |
| 3,869,401 | 3/1975 | Ernst | 252/100 X |
| 3,905,907 | 9/1975 | Shiga | 134/3 X |

*Primary Examiner*—S. Leon Bashore
*Assistant Examiner*—Marc L. Caroff
*Attorney, Agent, or Firm*—Flynn & Frishauf

[57] ABSTRACT

In the surface treatment of copper and its alloys with an acidic aqueous solution of hydrogen peroxide, methylcyclohexanol or cyclohexanol or both of the two are added to the solution thereby inhibiting the hindering action of chlorine ion in removal of metals and oxide scales by dissolution.

3 Claims, No Drawings

METHOD OF TREATING SURFACE OF COPPER AND ITS ALLOYS

BACKGROUND OF THE INVENTION

1. Field of the invention

This invention relates to a method of chemical surface treatment of copper and its alloys with an acidic aqueous solution of hydrogen peroxide in which hindering action of dissolved chlorine ion in removal of the metals and oxide scales by dissolution is inhibited. More particularly, it is directed to inhibiting the hindering action of dissolved chlorine ion in the chemical surface treatment of copper and its alloys such as the pcikling, etching or chemical polishing for which an acidic aqueous solution of hydrogen peroxide is used by adding to the solution methylcyclohexanol or cyclohexanol or both of the two.

2. Description of the Prior Art

Chemical surface treatments such as pickling which involves dissolving oxide scales on the surface of metallic material for the removal, etching which involves removing a portion of the metal layer by dissolution and chemical polishing which involves glazed treatment of the surface are widely used in industrial fields in which metallic materials are dealt with.

It is known that the acidic aqueous solution of hydrogen peroxide has an excellent dissolving activity as a chemical surface-treating agent for copper and copper-alloy materials. However, when there is incorporated chlorine ion at 1 p.p.m. or more in the solution, the metal- or oxide scale-dissolving activity will be greatly reduced with unsatisfactory finishing of the pickling, etching or chemical polishing resulted. In order to improve the reduction, there is heretofore known a method in which a silver compound such as silver nitrate or sulfate is added to remove the incorporated chlorine ion as precipitates of inactive silver chloride. In the method, however, it is difficult to add the silver ion in an amount equivalent to the chlorine ion. If the silver ion is added in excess, silver will be precipitated upon the surface of copper and its alloys with an disadvantage that dissolution of the metal or oxide scale is undesirably inhibited.

SUMMARY OF THE INVENTION

I have now found that addition of methylcyclohexanol or cyclohexanol or both of the two enables inhibition of the action of chlorine ion hindering removal of the metals and oxide scales by dissolution and the chemicals are the hindrance inhibitors very useful in practice.

The present invention, which is based upon the above-mentioned finding, provides a method of inhibiting the hindrance superior to any of the known methods of inhibiting the hindering action of chlorine ion.

DESCRIPTION OF THE INVENTION

In general, the aqueous hydrogen-peroxide solution used for the chemical surface treatments of copper and its alloys contains 10–150 g./l. of hydrogen peroxide, 10–200 g./l. of sulfuric acid, and additionally, a stabilizer for hydrogen peroxide and a surface active agent. The solution, which is a very effective surface-treating agent in the absence of chlorine ion, will be extremely deteriorated in activity of dissolving the metals and oxide scales and lose the chemical polishing activity if chlorine ion is incorporated from diluent water or others.

Whereas the influence of chlorine ion can be excluded when deionized water is used as the diluent water. However, its use is expensive so that it is infeasible on an industrial scale. On the other hand, water for industry and city water, which is generally used for surface treatment of copper and its alloys, usually contain chlorine ion at 10 ppm or more.

This invention is concerned with a method of inhibiting the action of chlorine ion hindering removal of copper and its alloys and their oxide scales by addition of methylcyclohexanol or cyclohexanol or both of the two to an acidic aqueous solution of hydrogen peroxide, according to which method it is feasible to employ water containing chlorine ion.

According to the present invention, addition of methylcyclohexanol or cyclohexanol or both of the two in an amount of 0.1 g./l. or more produces the expected results though the amount less than 0.1 g./l. will produce some but unsatisfactory results. The effect will be increased with increase in the amount added up to a nearly constant effect at 5 g./l. There will be no problem with the addition more than 5 g./l. but it is uneconomical.

The acid employed in the method of the invention includes mineral acids excluding hydrochloric acid such as sulfuric, nitric and phosphoric acids.

To the acidic aqueous solution of hydrogen peroxide with methylcyclohexanol or cyclohexanol or both of the two added according to the invention may well be added, as needed, a hydrogen peroxide-decomposition inhibitor including glycol ethers such as ethylene glycol monomethyl ether, ethylene glycol monoethyl ether and ethylene glycol monobutyl ether, saturated aliphatic alcohols such as methyl alcohol, ethyl alcohol and butyl alcohol, carboxylic acids, amino carboxylic acids and phosphonic acids. In addition, addition of a surface active agent for reducing surface tension to improve contact between the metal and the liquid will exert no influence upon the results of the invention at all.

The metal-treating temperature between 20 and 50° C. is suitable. At lower temperatures, the expected results will not satisfactorily be produced, while higher temperatures is undesirable because of promotion of decomposition of the hydrogen peroxide with a shorter life of the treating solution resulted.

DESCRIPTION OF PREFERRED EMBODIMENT

Comparative examples and examples of the invention will be given below. It is to be understood that the invention is not limited thereto.

COMPARATIVE EXAMPLE 1

A brass plate (Cu 60, Zn 40) with oxide coating was treated by dipping in an aqueous solution containing 20 g./l. of $H_2O_2$, 70 g./l. of $HNO_3$, 10 ml./l. of ethylene glycol monoethyl ether, 1 g./l. of a non-ionic surface active agent and 5 ppm of $Cl^-$ at 40° C. for 1 minute. Removal of the oxide coating was not satisfactory.

COMPARATIVE EXAMPLE 2

A beryllium-copper alloy plate was treated by dipping in an aqueous solution containing 50 g./l. of $H_2O_2$, 40 g./l. of $H_2SO_4$, 20 g./l. of $HNO_3$, 50 ml./l. of methyl alcohol, 2 ml./l. of a non-ionic surface active agent and 5 ppm of $Cl^-$ at 25° C. for about 2 min. There was produced black stripes on the surface.

COMPARATIVE EXAMPLE 3

A pure copper plate with oxide coating was dipped in an aqueous solution containing 40 g./l. of $H_2O_2$, 150 g./l. of $H_2SO_4$, 50 ml./l. of ethyl alcohol, 0.5 g./l. of a non-ionic surface active agent and a predetermined amount of chlorine ion at 40° C. for about 1 minute. The results are shown in Table 1.

Table 1.

| Cl− content | Finished appearance |
|---|---|
| 0 | Good removal of oxide coating |
| 5ppm | Incomplete removal of oxide coating with black stripes throughout developed. |

COMPARABLE EXAMPLE 4

In an aqueous solution containing 70 g./l. of $H_2O_2$, 100 g./l. of $H_2SO_4$, 100 g./l. of $H_3PO_4$, 20 ml./l. of ethylene glycol monoethyl ether and a predetermined amount of chlorine ion at 40° C. with vigorous stirring was dipped a pure copper plate and measurements were made of the rate of dissolution. The results are shown in Table 2.

Table 2.

| Cl− content | Rate of dissolving the copper |
|---|---|
| 0 | 21.1 μ/min. |
| 5ppm | 1.6 μ/min. |

EXAMPLE 1

To the solution of Comparative Example 1 was added cyclohexanol at 0.5 g./l. In the resulting solution at 40° C. was dipped a brass plate (Cu 60, Zn 40) with oxide coating for about 1 minute. Removal of the oxide coating was good.

EXAMPLE 2

To the solution of Comparative Example 2 was added methylcyclohexanol at 1 g./l. In the resulting solution at 25° C. was dipped a berylliom-copper alloy plate for about 2 minutes. There was produced a glazed surface.

EXAMPLE 3

A pure copper plate was dipped in an aqueous solution containing 100 g./l. of $H_2O_2$, 100 g./l. of $H_2SO_4$, 20 ml./l. of ethylene glycol monomethyl ether, 1 g./l. of a non-ionic surface active agent, 50 ppm of Cl− and 5 g./l.. of cyclohexanol at 45° C. for 10 sec. There was produced a glazed surface.

EXAMPLE 4

A pure copper plate with oxide coating was dipped in an aqueous solution containing 40 g./l. of $H_2O_2$, 150 g./l. of $H_2SO_4$, 50 ml./l. of ethyl alcohol, 0.5 g./l. of a non-ionic surface active agent, 5–50 ppm of Cl− and 0.1 – 5 g./l. of methylcyclohexanol at 40° C. for about 1 minute. Results of the treatment are shown in Table 3.

Table 3.

| Additive of the invention | | Cl− | Finished |
|---|---|---|---|
| Nature | Amount added | content | appearance |
| Methylcyclo-hexanol | 0.1 g./l. | 5ppm | Good |
| " | " | 10 | " |
| " | 0.5 g./l. | 20 | " |
| " | 1.0 g./l. | 30 | " |
| " | 5.0 g./l. | 50 | " |

EXAMPLE 5

To a solution containing 70 g./l. of $H_2O_2$, 100 g./l. of $H_2SO_4$, 100 g./l. of $H_3PO_4$, 20 ml./l. of ethylene glycol monoethyl ether and 10–30 ppm of Cl− is added cyclohexanol or methylcyclohexanol. In the resulting solution at 40° C. was dipped with vigorous stirring a pure copper plate. Measurements were made of rate of dissolution. The results are shown in Table 4.

Table 4

| Additive of the invention | | Cl− | Rate of |
|---|---|---|---|
| Nature | Amount added | content | dissolution |
| Cyclohexanol | 0.5 g./l. | 10ppm | 18.6 μ/min |
| " | 1.0 | 20 | 18.3 |
| " | 5.0 | 30 | 20.7 |
| Methylcyclo-hexanol | 0.5 | 10 | 20.1 |
| " | 1.0 | 20 | 19.8 |
| " | 5.0 | 30 | 20.3 |

I claim:

1. In a method of treating surfaces of copper and its alloys to dissolve a layer of metal or oxide scale thereon by contacting said surfaces with an acidic aqueous solution of hydrogen peroxide in the presence of chlorine ions, the improvement which comprises adding to the solution a compound selected from the group consisting of cyclohexanol, methylcyclohexanol, and mixtures thereof, in an amount effective to inhibit reduction of the dissolving activity of the solution by the chlorine ions.

2. The method according to claim 1 wherein the compound is added to the solution in an amount of the range of 0.1 – 5 g./l.

3. The method according to claim 1 wherein the surface treatment is carried out at a temperature between 20° and 50° C.

* * * * *

UNITED STATES PATENT AND TRADEMARK OFFICE

CERTIFICATE OF CORRECTION

PATENT NO. : 4,040,863

DATED : August 9, 1977

INVENTOR(S) : KOJI KITAMURA

It is certified that error appears in the above-identified patent and that said Letters Patent are hereby corrected as shown below:

1) Column 1, line 14: replace "pcikling" with --- pickling ---.

2) Column 1, line 42: before "disadvantage", replace "an" with --- the ---.

3) Column 1, lines 47-51, delete in entirety and replace with the following:

--- I have now found that addition of methylcyclohexanol or cyclohexanol, or both, allows inhibition of the action of chlorine ions which hinder removal of metals and oxides by dissolution. These chemicals are very useful as hindrance inhibitors. ---.

4) Column 2, line 45: before "undesirable", replace "is" with --- are ---.

5) Column 2, line 47: replace "resulted" with --- resulting ---.

UNITED STATES PATENT AND TRADEMARK OFFICE

CERTIFICATE OF CORRECTION

PATENT NO. : 4,040,863

DATED : August 9, 1977

INVENTOR(S) : KOJI KITAMURA

It is certified that error appears in the above-identified patent and that said Letters Patent are hereby corrected as shown below:

6) Column 2, line 67: replace "was" with --- were ---.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*